United States Patent [19]

Davidson et al.

[11] 4,360,416

[45] Nov. 23, 1982

[54] ANODE CATALYSTS FOR ELECTROLYSIS OF BRINE

[75] Inventors: Craig R. Davidson, Hampstead, N.H.; John M. Sedlak, Andover, Mass.

[73] Assignee: General Electric Company, Wilmington, Mass.

[21] Appl. No.: 258,126

[22] Filed: Apr. 27, 1981

Related U.S. Application Data

[62] Division of Ser. No. 145,936, May 2, 1980, abandoned.

[51] Int. Cl.[3] ..... C25B 9/00; C25B 11/06; C25B 11/08; C25B 13/08

[52] U.S. Cl. ..... 204/266; 204/98; 204/128; 204/129; 204/263; 204/283; 204/291; 204/292; 204/293

[58] Field of Search ..... 204/98, 128, 129, 263, 204/266, 282, 283, 291-293

[56] References Cited

U.S. PATENT DOCUMENTS

| | | |
|---|---|---|
| 3,134,697 | 5/1964 | Niedrach . |
| 3,297,484 | 1/1967 | Niedrach . |
| 3,663,414 | 5/1972 | Martinsons et al. . |
| 3,711,385 | 1/1973 | Beer . |
| 3,720,590 | 3/1973 | DeWitt et al. . |
| 3,751,296 | 8/1973 | Beer et al. . |
| 3,775,284 | 11/1973 | Bennett et al. . |
| 3,840,443 | 10/1974 | Beer . |
| 3,992,271 | 11/1976 | Danzig et al. . |
| 4,039,409 | 8/1977 | LaConti et al. . |
| 4,191,618 | 3/1980 | Coker et al. . |

FOREIGN PATENT DOCUMENTS 1147442 4/1969 United Kingdom .

*Primary Examiner*—R. L. Andrews
*Attorney, Agent, or Firm*—I. David Blumenfeld

[57] ABSTRACT

A gas generating apparatus and method is described which utilizes a novel catalytic halogen evolving electrode for electrochemical systems, such as an electrolysis cell for the generation of chlorine. The electrochemical cells include a catalytic cathode and an improved catalytic anode positioned on opposite sides of, and bonded to, a solid polymer electrolyte membrane. A source of direct current potential between the cathode and the anode and means for removing gas from at least one of the electrodes are provided. The improved catalytic anode is an alloy of ruthenium oxide and manganese oxide. In one embodiment, chlorine is electrolytically generated by providing a catalytic cathode; providing a catalytic chlorine evolving anode wherein the chlorine evolving anode comprises ruthenium oxide and manganese oxide; positioning a solid polymer electrolyte ion transporting membrane between the cathode and the anode, the cathode being bonded to one surface of the membrane and the anode being bonded to the other surface of the membrane; and providing a direct potential between the cathode and the anode and supplying brine to one of the electrodes to be acted on electrochemically to evolve chlorine at the anode. By adding the manganese oxide to the ruthenium oxide, the ruthenium oxide is stabilized, and there is substantial improvement in anode life in an electrolysis cell when the ruthenium oxide/manganese oxide catalyst material is used as an anode therein without sacrifice to cell efficiency and cell voltage.

5 Claims, 2 Drawing Figures

ANODE CATALYSTS FOR ELECTROLYSIS OF BRINE

This application is a division of application Ser. No. 145,936, filed May 2, 1980 now abandoned.

This invention relates to methods and apparatus for the generation of gases, and more particularly, it relates to improved catalytic halogen-evolving anodes for the generation of halogen gases by electrolysis. As used herein, halogen gas generally refers to chlorine and bromine.

Electrochemical cells of the type utilizing an ion exchange membrane, otherwise known as, and designated herein as, a solid polymer electrolyte membrane, associated with a pair of catalytic electrodes have been described in the prior art in various forms and for various applications. In the present invention, the electrochemical cells are utilized for gas generation by electrolysis.

Various metals and metal alloys have been utilized as the catalytic electrodes in electrochemical cells. The performance of the catalyst at the gas evolving electrode (anode) is crucial in the effectiveness and efficiency of the electrochemical cell, and consequently, it is crucial in the economics of the gas evolving process. Such catalysts as platinum, platinum black, platinum-iridium alloy, a reduced alloy of platinum-ruthenium, and other reduced platinum group metal oxides and the like, have been used in the past as catalysts for these electrochemical cells. Ruthenium oxide catalyst material has been one of the best electrode catalyst materials reported to date because of its high chlorine evolution activity. However, the chlorine evolution activity of the ruthenium oxide decreases with time, and the susceptibility of ruthenium oxide to corrosion increases with time.

Electrochemical cells and methods for gas generation utilizing specific catalysts and electrodes are well known in the prior art. In U.S. Pat. No. 3,992,271, an electrolysis and oxygen concentrating cell utilizing an oxygen evolving catalytic anode is described. The oxygen evolving catalytic anode utilizes a platinum-iridium alloy and provides improved performance and efficiency even though the use of such platinum-iridium alloys as electrodes in fuel cells had always resulted in poorer performance of the cell. However, the iridium, as well as the platinum, utilized as the alloying metals in the catalyst of U.S. Pat. No. 3,992,271 is quite expensive, and it was discovered in U.S. Pat. No. 4,039,409 that a reduced alloy of platinum and ruthenium containing about 5 to 60% ruthenium, had better performance than the reduced platinum-iridium alloy catalyst, and it was much less expensive to produce since the cost of ruthenium salts utilized to fabricate the platinum-ruthenium alloy was approximately one-half the cost of the iridium salts. Thus, in U.S. Pat. No. 4,039,409, there was provided a catalytic cathode and a gas evolving catalytic anode containing a reduced platinum-ruthenium alloy containing 5% to 60% by weight of ruthenium positioned on opposite faces of a cation exchange membrane. However, these alloys are vulnerable to the harsh effects of electrolysis reactions and chlorine gas, and consequently, they are not stable enough for prolonged use as anode materials in the electrolysis of brine and other halogen-producing media. Furthermore, the platinum moiety is rather expensive, and less expensive materials are preferred for electrode materials.

Although these prior art gas generating and concentrating devices and processes work efficiently, it is always desirable to improve the efficiency of the devices and processes and at the same time reduce the cost of the devices and processes. Furthermore, it is always desirable to improve the resistance of the materials used in the electrochemical cells to the corrosion effects of chemicals, and especially to stabilize the gas generating anode against corrosion. Since these electrochemical gas generating devices utilize and/or generate caustic or alkaline media, there is a tendency of these media, as well as the chlorine gas, to corrode the catalysts, especially the catalysts used at the anode, and thereby reduce the life of the device.

Stabilized electrocatalysts have been used as electrodes in processes and devices for the generation of chlorine by electrolysis of an aqueous alkali metal halide at the anode of an electrolysis cell which includes a solid polymer electrolyte in the form of a cation exchange membrane to separate the cell into catholyte and anolyte chambers. The catalytic electrodes at which the chlorine and caustic are produced, are thin, porous, gas permeable, catalytic electrodes which are bonded to opposite surfaces of the membrane so that the chlorine is generated at or near the membrane interface. To stabilize the electrode catalysts against the corrosive effects of chlorine and other products and reactants normally present during electrolysis conditions, one or more reduced oxides of a valve metal such as titanium, tantalum, niobium, zirconium, hafnium, vanadium or tungsten, are added to the reduced oxides of a platinum group metal such as platinum, palladium, iridium, rhodium, ruthenium, and osmium. The prior art also teaches conventional cathode catalyst materials of finely-divided metals of platinum, palladium, gold, silver, spinels, manganese, cobalt, nickel, reduced platinum-group metal oxides (Pt-IrOx and Pt-RuOx), graphite and suitable combinations thereof. However, these materials are proposed as catalytic cathode materials in an electrochemical cell for the production of chlorine from brine. Furthermore, these metals are still subject to corrosive effects even when used in combinations, and it is desirable to improve the stability of gas generating anodes against the harsh conditions in electrochemical cells.

In British Pat. No. 1,147,442, chemically resistant non-film-forming materials are provided upon a core of film-forming metal to make improved electrodes for electrolysis. The thin layer of non-film-forming materials which contact the electrolyte, are chemically resistant to the effect of the electrolyte and the products of the electrolysis. The non-film-forming materials include at least one oxide of a metal of the platinum group, i.e., an oxide of a metal taken from the group consisting of platinum, iridium, rhodium, palladium, ruthenium, and osmium and alloys formed between these metals, or consists of a mixture of at least one oxide of a metal of the platinum-metals group with at least one oxide from the group consisting of manganese, lead, chromium, cobalt, iron, titanium, tantalum, zirconium, and silicon. Although these materials may exhibit a degree of stability upon a metal core, most of the species are undesirable as electrode materials in electrochemical cells for the electrolysis of water or chlorine because they are inherently unstable by themselves in an acid media or because they do not contribute substantially to any improvement of the catalytic activity of ruthenium oxide as an electrode material. Furthermore, in most cases, when these materials are used as catalytic anodes in electrochemical cells which utilize a catalytic cathode and catalytic gas evolving anode in contact with a solid polymer electrolyte membrane for electrolysis of water or brine, cell voltage and cell efficiency, although acceptable initially, rapidly deteriorate within a short period of time.

The choice of catalyst in an electrochemical cell and its effectiveness in a given cell, depends upon a complex set of variables such as the surface area of a catalyst, availability of oxides of its species on the catalyst surface, contaminants in the reactant, and the nature of the conversion taking place in the cell. Consequently, it is and always has been difficult to predict the applicability of a catalyst useful in one electrochemical cell system to a different system. Even though one type of catalyst may produce advantageous results in one type of electrochemical cell system, it does not always follow that such an improvement will be realized when the same catalyst is utilized in a different electrochemical cell system. As explained above, it is always desirable not only to improve the stability of the catalysts and other elements of the electrochemical cells, but it is always desirable to improve the efficiencies of the electrochemical cells and the processes carried out therein.

It is, therefore, the primary object of the present invention to provide an improved method, apparatus and electrode for halogen gas generation utilizing an improved electrocatalyst at the gas evolving electrode.

It is a further object of the present invention to provide an improved gas generation apparatus, process and electrode with which to produce halogen gases by electrolysis, by utilizing a catalyst which provides improved performance, improved stability and reduced cost.

Another object of this invention is to provide an anode, method and apparatus for producing halogen gases by the electrolysis of media which evolve a halogen gas by electrolysis.

Still another object of the present invention is to provide an improved gas generation apparatus and a process for producing chlorine or bromine by electrolysis utilizing an improved, stable catalyst at the halogen evolving anode.

Another object of the present invention is to provide an improved gas generation apparatus, method and anode for producing gases by electrolysis wherein there is little or no deterioration in cell voltage and cell efficiency.

Other objects and advantages of the invention will become apparent from the following description.

In accordance with the invention, halogens are electrolytically generated from a halogen-containing electrolyte comprising:

(a) providing a catalytic cathode;
(b) providing a catalytic halogen-evolving anode
(c) positioning a solid polymer electrolyte ion transporting membrane between the cathode and the anode, the cathode being bonded to one surface of the membrane and the anode being bonded to the other surface of the membrane; and,
(d) providing a direct potential between the cathode and the anode and supplying a halogen-containing electrolyte to one of the electrodes to be acted on electrochemically to evolve halogen gas at the anode;

the improvement comprising providing a catalyst at the halogen evolving anode comprising ruthenium oxide and manganese oxide. By adding the manganese oxide to the ruthenium oxide, the ruthenium oxide is stabilized, and there is substantial improvement in cell voltage in an electrolysis cell when the ruthenium oxide/manganese oxide catalyst material is used as an anode therein.

In general, the apparatus for the evolution of halogen gas comprises, a catalytic cathode; a catalytic halogen-evolving anode comprising a catalyst of ruthenium oxide and manganese oxide; a solid polymer electrolyte ion transporting membrane disposed between and bonded to the catalytic cathode and the catalytic halogen-evolving anode; means for providing a direct current potential between the cathode and the anode; and, means for supplying a medium which evolves halogen in an electrolysis reaction.

By using the improved halogen-evolving anode of the present invention wherein the anode comprises ruthenium oxide and manganese oxide, performance of an electrolysis cell for generating halogens, e.g., chlorine, is actually as good as or better than the performance of electrolysis cells using more expensive anode catalysts, for example, ruthenium oxide alone. By using the manganese oxide with the ruthenium oxide as a stabilizer for the ruthenium oxide, it has been found that, relative to current density, the performance of the electrolysis cell for the electrolysis of brine to produce chlorine gas is as good as the performance of the cell using the ruthenium oxide catalyst. Furthermore, the cost of the catalyst material is substantially less expensive when the ruthenium oxide is used in conjunction with the manganese oxide. The stability of the ruthenium oxide-manganese oxide catalytic anode is substantially improved over the stability of the ruthenium oxide catalyst alone or over other prior art electrodes used for the electrolysis of brine to produce chlorine gas. There is very little loss of halogen evolution activity and little corrosion of the ruthenium oxide-manganese oxide catalyst with time when the catalyst is utilized as an anode in an electrolytic cell for the generation of halogen gas from halogen-containing electrolyte or from a medium which evolves halogen during electrolysis.

In accordance with the present invention, halogens, e.g., chlorine, bromine, and the like, are continuously produced from alkali metal halides, e.g., sodium chloride, sodium bromide and the like, by the method comprising, continuously bringing or supplying an aqueous alkali metal halide solution to the anode chamber by a solid polymer electrolyte ion transporting membrane; bringing the solution into contact with a porous gas permeable catalytic anode electrode bonded to the membrane on the side facing the anode chamber, whereby electrolysis takes place at or near the membrane-electrode interface, and opposite to a porous, gas permeable, catalytic cathode on the other side of the membrane; continuously bringing a stream of aqueous catholyte, e.g., water, into the cathode chamber and into contact with the catalytic cathode electrode; supplying current to the electrodes to electrolyze the alkali metal halide at the anode to produce halogen and to electrolyze catholyte at the cathode electrode to produce electrolysis products; and continuously removing halogen from the anode compartment and electrolysis products from the cathode compartment; the improvement comprising providing a porous, gas permeable, catalytic anode comprising ruthenium oxide and manganese oxide.

The electrode of the present invention for an electrolysis cell comprises a solid polymer electrolyte base member having two surfaces, the first surface having an anode catalyst material comprising ruthenium oxide and manganese oxide bonded thereto and a second surface having a cathode catalyst bonded thereto. It is the ruthenium oxide anode catalyst containing stabilizing amounts of manganese oxide which stabilizes the ruthenium oxide in the acid media and in the presence of the other harsh conditions which accompany electrolysis, without sacrificing the activity of the ruthenium oxide for evolution of oxygen gas.

As used herein, medium which evolves halogen, halogen-containing medium and halogen-containing electrolyte are used interchangeably and refer to any fluid or aqueous solution or suspension which produces a halogen gas or a combination of halogen gases when electrical current is supplied thereto, as in an electrolysis reaction. They include aqueous sodium chloride, aqueous potassium chloride, aqueous sodium bromide, aqueous potassium bromide, brine, and the like.

These and various other objects, features and advantages of the invention can be best understood from the following description taken in connection with the accompanying drawings in which.

Figure 1:
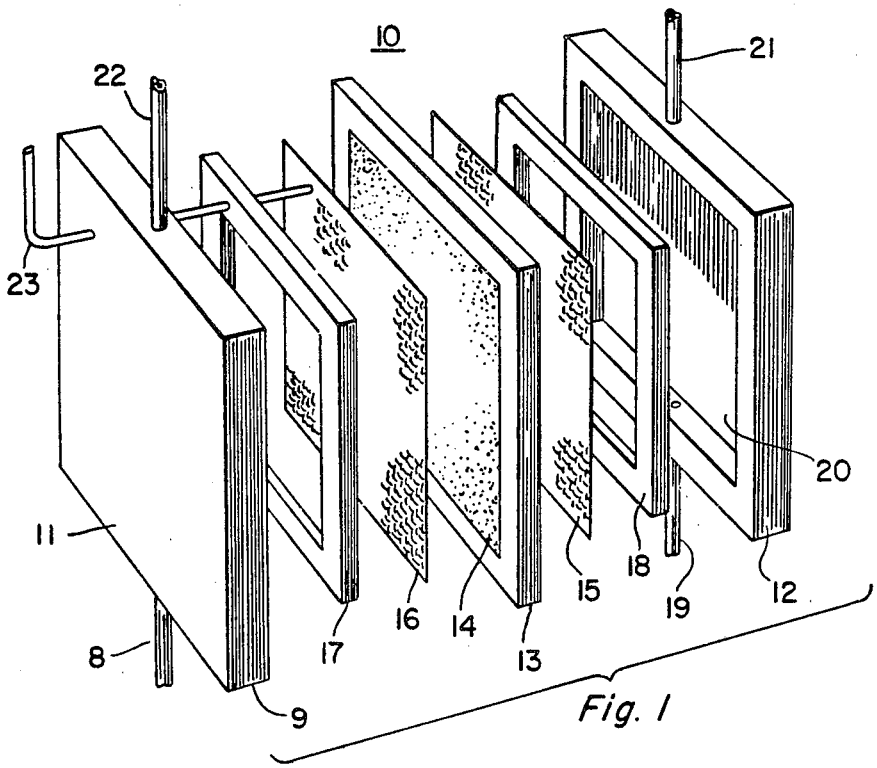
FIG. 1 is a diagrammatic illustration of an exemplary electrolysis cell constructed with the catalytic anode comprising ruthenium oxide and manganese oxide in accordance with the present invention.

Referring to FIG. 1, where there is shown a disassembled typical electrolysis cell in which the improved anode catalyst of the present invention can be used, electrolysis cell 10 generally consists of a cathode compartment 20, an anode compartment 9, separated by a solid polymer electrolyte ion transporting membrane 13, which is preferably a hydrated, ion permeable membrane of the type comprising a cation exchange resin. Bonded to the surfaces of membrane 13 so that they form an integral part of the respective surfaces of membrane 13, are electrodes comprising anode 14 and a cathode (not shown). Anode compartment 9 is on that side of membrane 13 to which the anode 14 is bonded. Cathode compartment 20 is on that side of the membrane to which the cathode is bonded. Bonded to the anode surface of membrane 13 is the anode catalyst of the present invention comprising ruthenium oxide and manganese oxide. The cathode (not shown) is bonded to the side of membrane 13 which is opposite anode 14. Suitable catalyst materials for the cathode include finely-divided metals of platinum, palladium, gold, silver, spinels, manganese, cobalt, nickel, reduced platinum-group metal oxides, graphite, and the like.

Current collectors in the form of metallic screens 15 and 16 are pressed against the respective electrodes. The whole membrane/electrode assembly is firmly supported between housing elements 11 and 12 by means of gaskets 17 and 18 which are made of any material resistant or inert to the cell environment, namely halogens, oxygen, aqueous alkali metal halide, and caustic. One form of such a gasket is a filled organic rubber gasket, ethylene propylene terpolymer, sold by the Irving Moore Company of Cambridge, Massachusetts under its trade designation EPDM. Another preferred gasket material is lead oxide filled VITON. VITON is a trademark of E.I. du Pont deNemours and Co. Gaskets 17 and 18 may be any suitable sealing means including cement to secure the elements together or O-rings to seal the respective chambers. In certain cases, gaskets or cement 17 and 18 may be omitted.

The aqueous brine anolyte solution is introduced through an electrolyte inlet 8 which communicates with anode chamber or anode compartment 9. Spent electrolyte and chlorine gas are removed through an outlet conduit 22 which also passes through housing 11. A cathode inlet conduit 19 communicates with cathode compartment or chamber 20 and permits the introduction of the aqueous catholyte, water or aqueous sodium hydroxide into the cathode chamber. The water serves two separate functions. A portion of the water is electrolyzed to produce hydroxyl ($OH^-$) anions which combine with the sodium cations transported across the membrane to form caustic (NaOH). It also sweeps across the cathode bonded to membrane 13 to dilute the highly concentrated caustic formed at the membrane/electrode interface to minimize diffusion of the caustic back across the membrane into the anolyte chamber. Cathode outlet conduit 21 communicates with cathode chamber 20 to remove the diluted caustic, plus any hydrogen discharged at the cathode and any excess water.

Cathode inlet conduit 19 is optional, and generally there is no advantage in circulating catholyte through cathode chamber or compartment 20 in the electrolysis of brine. In such cases, cathode outlet conduit 21 communicates with cathode chamber 20 to remove dilute caustic, hydrogen or any other product discharged at the cathode. A power cable 23 is brought into the anode chamber and a comparable cable (not shown) is brought into the cathode chamber. The cables connect the current conducting screens 15 and 16 to a source of electrical power. The foregoing electrolysis cell 10 is described merely for the purposes of exemplifying the use of the ruthenium oxide-manganese oxide alloy anode catalyst of the present invention.

Figure 2:
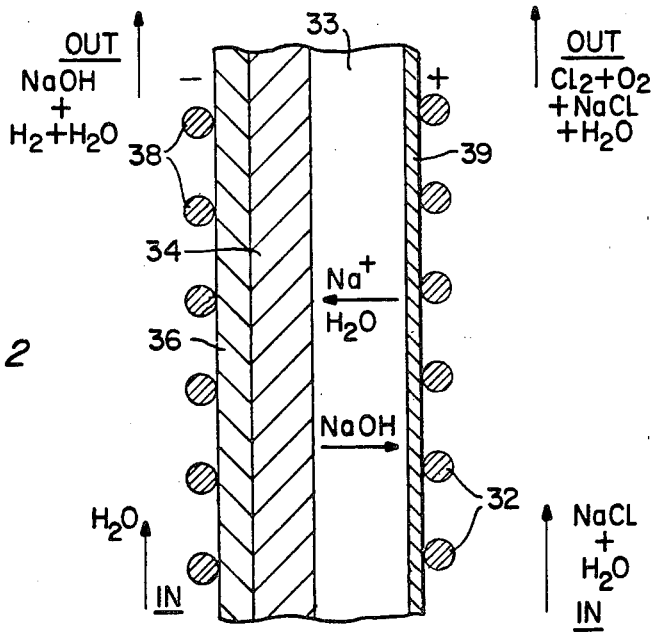
FIG. 2 is a schematic illustration of the solid polymer electrolyte ion transporting membrane and the major reactants and products which are found in relation to the anode and cathode.

FIG. 2 illustrates diagramatically a section of a preferred electrode-membrane-current collecting assembly in which the improved anode catalyst of the present invention can be utilized. FIG. 2 shows electrolytes in and the electrolysis reaction products out of the cell as a result of the electrolysis of brine (aqueous sodium chloride). Porous, gas permeable anode 39 is bonded to one surface of solid polymer electrolyte membrane 33, and porous, gas permeable cathode 34 is bonded to the other surface of solid polymer electrolyte membrane 33. Anode current collector 32 is a metallic point contact collector and is in electrical contact with porous anode 39. Current collector 38 is a metallic point contact collector and is in electrical contact with graphite sheet 36 which in turn contacts cathode 34. Graphite sheets are optional and in certain preferred embodiments, they are used between the current collector and the electrode as shown in FIG. 2. Point contact collectors, corrugated metal contact devices, metal screens and various other conductive current collectors may be used in electrical contact with the electrodes. Porous anode 39 and porous cathode 34 are bonded to and form an integral part of the respective surfaces of solid polymer electrolyte membrane 33 in any well-known manner to establish electrical contact between the electrode and the respective surface of solid polymer electrolyte membrane 33.

In accordance with the present invention, anode catalyst 39 comprises ruthenium oxide and manganese oxide.

In FIG. 2, it can be seen that in the electrolysis of brine, sodium chloride and water enter into the presence of anode catalyst 39, and chlorine gas, oxygen, sodium chloride and water exit or leave the cell on the side of the anode catalyst. As illustrated in FIG. 2, sodium ion and water migrate from the direction of the anode to the cathode through the solid polymer electrolyte membrane. In the example shown in FIG. 2, water is used as the electrolyte on the side of the membrane having cathode 34, and sodium hydroxide, hydrogen and water leave or exit from the electrochemical cell on the side of the membrane having cathode catalyst 34 thereon.

The reactions in various portions of a typical electrochemical cell in which brine (aqueous sodium chloride) is electrolyzed are as follows:

GENERAL REACTION (OVERALL):

$$2NaCl+2H_2O \rightarrow 2NaOH+Cl_2+H_2$$

ANODE:

$$2Cl \rightarrow Cl_2\uparrow +2e^-$$

$$4OH^- \rightarrow O_2+2H_2O+4e^- \text{(parasitic)}$$

CATHODE:

$$2H_2O \rightarrow 2OH^- +H_2\uparrow -2e$$

$$2Na^+ +2OH^- \rightarrow 2NaOH$$

MEMBRANE TRANSPORT:

$$2Na^+ +H_2O$$

The production of oxygen at the anode is undesirable since it can have troublesome effects on the electrode and the membrane, and it is described as a parasitic reaction which reduces the cathode current efficiency. However, in accordance with the present invention, the anode catalyst material comprising ruthenium oxide and manganese oxide alloy wherein the manganese oxide stabilizes the ruthenium oxide, the oxygen has a reduced corrosive effect upon the anode catalyst because of the improved anode catalyst material of the invention. It is to be kept in mind that the catalytic sites in the electrodes are in direct contact with the solid polymer electrolyte ion transporting membrane and the ion exchanging acid radicals attached to the polymer backbone of the ion exchange resin material in the solid polymer electrolyte membrane (whether these radicals are the $SO_3H$ sulfonic radicals or the COOH carboxylic acid radicals or some other radical).

Additional information relating to the construction and operation of electrolysis cells having catalytic electrodes bonded to the surface of a solid polymer electrolyte membrane for the production of halogens can be found in the prior art including United States Application Ser. No. 922,316, now U.S. Pat. No. 4,224,121, filed July 6, 1978 in the name of T. G. Coker et al., asigned to the instant assignee and entitled "Production of Halogens By Electrolysis of Alkali Metal Halides In An Electrolysis Cell Having Catalytic Electrodes Bonded To The Surface Of A Solid Polymer Electrolyte Membrane."

The catalytic electrodes used in the electrochemical cells may be constructed by any of the techniques well-known in the prior art. Anode and cathode materials may be prepared by the Adams method or by modifying the Adams method or by any other similar techniques. For example, by the Adams method as described in U.S. Pat. No. 4,039,409, the catalytic alloy can be prepared by thermally decomposing the mixed metal salts of the compounds used in the alloy. The chloride salts of ruthenium and the sulfate salts of manganese are mixed with an excess of sodium nitrate. The ruthenium chloride and manganese sulfate are mixed in the same weight ratio of ruthenium and manganese desired in the final alloy with the excess sodium nitrate, and the mixture is fused in a silica dish at about 500° C. for about 3 hours. The residue is then washed thoroughly to remove any water-soluble salts such as soluble nitrates, halide salts (chlorides), sulfates, or any other soluble salts, leaving a residue of the ruthenium oxide/manganese oxide alloy. The alloy may be dried thoroughly and comminuted to the appropriate particle size. The resulting product may be graded to size by any appropriate means, for example, the product may be sifted through sieves of the appropriate size, such as a 400 mesh nylon screen. The resulting alloy of the two oxides is black in appearance.

Anodes made from the ruthenium oxide and manganese oxide alloy of this invention may be prepared as decals and suitably bonded to the surface of solid polymer electrolyte membranes so that they form an integral part of the surface, or they may be made by a technique which embraces bonding the particulate or powdered anode catalyst material directly to the surface of the solid polymer electrolyte membrane, for example by a dry process technique which embraces abrading or roughening the surface of the solid polymer electrolyte membrane, preferably to place a cross-hatched pattern in the surface of the membrane, and fixing a low loading of anode catalyst particles upon the patterned surface, or they may be made by any well-known prior art process. In the dry process technique described in a copending patent application by Richard J. Lawrance and Linda D. Wood entitled "Method of Making Solid Polymer Electrolyte Catalytic Electrodes and Electrodes Made Thereby", and assigned to the instant assignee, anode catalyst material is applied to the surface of a solid polymer electrolyte membrane by first roughening the surface of the solid polymer electrolyte membrane; depositing anode catalyst particles upon the roughened surface; and fixing the anode catalyst particles thereto, e.g., by heat and/or pressure. The membrane is preferably in a dried state during the process and may be suitable hydrated after the fixing of the anode catalyst. A preferred cross-hatched pattern is placed in the membrane surface during the roughening step or steps by sanding the membrane with an abrasive in a first direction followed by sanding the membrane with the abrasive in a second direction, preferably at a 90° angle to the first direction.

Cathodes may also be made as described above. The cathode may be a Teflon-bonded cathode and is similar to the anode catalyst. Suitable cathode catalyst materials include finely-divided metals of platinum, palladium, gold, silver, spinels, manganese, cobalt, nickel, reduced platinum-group metal oxides, reduced platinum/ruthenium metal oxides, graphite and the like and combinations thereof. The graphite or other catalyst materials deposited upon the surface of the solid polymer electrolyte membrane are not critical in the practice of the present invention, and many well-known cathode materials may be used as the cathode in the present invention.

Ion exchange resins and solid polymer electrolyte membranes are described in U.S. Pat. No. 3,297,484 where catalytically active electrodes are prepared from finely-divided metal powders mixed with a binder such as polytetrafluoroethylene resin, and the electrode comprises a bonded structure formed from a mixture of resin and catalyst bonded upon each of the two major surfaces of a solid polymer electrolyte solid matrix, sheet or membrane. The resin and catalyst is formed into an electrode structure by forming a film from an emulsion of the material; or alternatively, the mixture of resin binder and catalyst material is mixed dry and shaped, pressed and sintered onto a sheet which can be shaped or cut to be used as the electrode, and bonded to the solid polymer electrolyte membrane. The resin and catalyst powder mix may also be calendered, pressed, cast or other wise formed into a sheet or decal, or fibrous cloth or may may be impregnated or surface coated with a mixture of binder and catalyst material. In other prior art techniques, the electrode material may be spread upon the surface of an ion exchange membrane or on the press platens used to press the electrode material into the surface of the ion exchange membrane and the assembly of the ion exchange membrane and the electrode materials are placed between the platens and subjected to sufficient pressure, preferably at an elevated temperature to cause the resin in either the membrane or in the admixture with the electrode catalyst material either to complete the polymerization if the resin is only partially polymerized, or to flow if the resin contains a thermoplastic binder. The method of placing the electrode or electrodes upon the surface of the membrane (solid polymer electrolyte ion transporting membrane) in accordance with the present invention is not critical, and any of the well-known prior art techniques may be used as long as the anode comprises ruthenium oxide and manganese oxide.

A variety of commercial ion exchange membranes may be used as the solid polymer electrolyte ion transporting membrane in the electrochemical cell. One such ion exchange membrane which functions very adequately is a perfluorocarbon sulfonic acid solid polymer electrolyte sold by E. I. Dupont de Nemours and Co. under the trade designation "NAFION".

It has been found that an improved halogen gas generation apparatus and an improved process for generating halogen gas from a medium such as, brine, by electrolysis, is possible by utilizing an improved electrode comprising a solid polymer electrolyte base member having two surfaces, the first surface having an anode catalyst material comprising ruthenium oxide and manganese oxide bonded thereto and a second surface having a cathode catalyst bonded thereto, the ruthenium oxide and manganese oxide preferably being an alloy wherein the manganese oxide is completely dissolved in the ruthenium oxide phase of the alloy. The improved catalytic anode of this invention provides superior stability in the generation of chlorine from brine by electrolysis. It has also been found that when the anode catalyst comprising ruthenium oxide is stabilized with manganese dioxide, and the composition is an alloy wherein manganese dioxide is completely dissolved in the ruthenium oxide, there is little or no sacrifice of the activity of the ruthenium oxide catalyst in performance in the electrolysis of brine.

Although the invention has been illustrated above with reference to the specific electrolysis configuration shown in FIG. 1, it is to be understood that the present invention embracing an improved anode material for electrolytically generating halogens from brine and other anolyte media with an anode catalyst at the halogen evolving anode comprising ruthenium oxide and manganese oxide, may be used in other configurations for the electrolysis of brines in an electrolysis cell wherein an anode catalyst material comprising ruthenium oxide and manganese oxide is bonded to and forms an integral part of one surface of a solid polymer electrolyte base member and a catalyst is bonded to and forms an integral part of the other surface of the solid polymer electrolyte base member.

In its broadest aspect, the improvement of the present invention is directed to the catalytic anode or catalytic halogen evolving anode wherein the improvement comprises providing a catalyst comprising ruthenium oxide and manganese oxide as the anode bonded to the solid polymer electrolyte ion transporting membrane. In the preferred embodiment, the ruthenium oxide and the manganese oxide are an alloy, and the manganese oxide is completely dissolved in the ruthenium oxide in a concentration of about 5 weight percent to about 25 weight percent manganese oxide (based upon the weight of the ruthenium oxide). The ruthenium oxide may be generally designated as $RuO_2 \cdot H_2O$, and the manganese oxide may be generally designated as $MnO_2$.

It has been found that the anodes made in accordance with the present invention and containing the manganese oxide-stabilized ruthenium oxide catalyst material substantially extends the life of the catalytic anode in the generation of chlorine in an electrochemical cell of the type having a catalytic cathode; a catalytic chlorine evolving anode; a solid polymer electrolyte ion transporting membrane positioned between the cathode and the anode, the cathode and the anode being bonded to the respective surfaces of the membrane. Furthermore, it has been discovered that there is little or no sacrifice in cell performance when the preferred ruthenium oxide anode catalyst material is diluted with (stabilized with) stabilizing concentrations of manganese oxide in the form of an alloy wherein the manganese oxide is completely dissolved in the ruthenium oxide.

The concentration of the manganese oxide in the ruthenium oxide is critical in the practice of the present invention, and it has been discovered that the upper limit of manganese oxide which may be used to stabilize the ruthenium oxide, is that concentration of manganese oxide which completely dissolves in the ruthenium oxide phase to form a true metal solution. This is defined herein as the upper limit of the stabilizing amount of manganese oxide in the ruthenium oxide. In preferred embodiments, the manganese oxide is present in the ruthenium oxide in the stabilizing amounts of about 5% by weight to about 25% by weight, based upon the weight of the ruthenium oxide. In the most preferred embodiments, the concentration of the stabilizing amounts of manganese oxide in the ruthenium oxide is about 10% by weight to about 15% by weight manganese oxide, based upon the weight of the ruthenium oxide. Generally, the lower concentrations of manganese oxide, i.e., from about 5% by weight to about 15% by weight manganese oxide, are preferred because of the lower electrical resistivity of the ruthenium oxide-manganese oxide alloy having the lower concentrations of manganese oxide therein. Naturally, the lower the cell resistance, i.e., electrical resistivity, the greater the efficiency of the electrochemical cell. X-Ray diffraction studies carried out upon the catalyst comprising 90% ruthenium oxide and 10% manganese oxide (by weight) showed a uniform ruthenium oxide structure indicative of the fact that the manganese oxide is present in solid solution. Studies on stability of the anode catalyst of the present invention and both chlorine and oxygen evolution activity showed only slight variations in cell potential over prolonged periods of operation in an electrochemical in which oxygen was prepared by the electrolysis of water and chlorine was prepared by the electrolysis of brine using the anode catalyst of the present invention.

Other materials may also be included in the anode catalyst composition of the improved catalytic anode as long as the materials do not effect the performance or stability of the electrode in the processes and apparatus of the invention. For example, various binders and extenders which are well-known in the art may be used in the catalytic anode. Extenders are generally materials having good conductivity and may contribute to the stability, life, porosity, conductivity, and the like of the catalyst material. For example, in certain cases, it has been found advantageous to use a binder to bond the catalyst material, that is, the ruthenium oxide-manganese oxide alloy to the solid polymer electrolyte ion transporting membrane. Binders are well-known in the art and include polytetrafluoroethylene particles which may be mixed with the alloy prior to fixing the material to the solid polymer electrolyte ion transporting membrane or prior to casting the catalytic electrode in the form of a decal, whichever technique is used to form the electrode and to bond it to the solid polymer electrolyte ion transporting membrane.

Any appropriate metal salts of ruthenium and metal salt of manganese may be used to produce the alloys of the present invention. The preferred salts have been discussed above. However, the sulfates, bromides, nitrates, iodides and any other common inorganic salt forms of the ruthenium and manganese can be used to prepare the alloys useful as anode catalysts in halogen generation in accordance with the present invention. The resulting alloy may be calcined, if desired. Calcining sharpens the crystalline structure of the alloy and is optional in the preparation of the alloy of the present invention. Although the calcining sharpens the crystalline structure of the product, it does not appear to have any effect upon the stability of the anode or upon the efficiency of the gas generation.

Although the anode catalyst has been defined herein as comprising ruthenium oxide and manganese oxide, it is not meant to preclude the inclusion of ruthenium and/or manganese metals in the alloy composition, and minor amounts of the metal in the non-oxide form may be present in the alloy composition without significantly impacting the stability of the anode catalyst or the cell efficiency. Accordingly, up to about 10% by weight of the ruthenium oxide-manganese oxide anode catalyst material may comprise the ruthenium metal and/or manganese metal in the free state (zero valence) or in the non-oxide state.

Anode and cathode current collectors well-known in the art may be used to engage the catalytic anode and the catalytic cathode respectively to make electrical contact therewith. The structure and composition of the current collectors is not critical in the practice of the present invention. Other features in the electrochemical cell are generally conventional and well-known in the prior art, exemplary of which are those features described in U.S. Pat. No. 3,992,271 and U.S. Pat. No. 4,039,409.

As explained above, the electrode may be formed from the ruthenium oxide-manganese oxide catalyst material alone by any suitable prior art method, or it may be used in conjunction with a binder to support the anode catalyst material. When "Teflon" is used as a binder, the electrode is formed as a "Teflon" bonded alloy mixture by blending the alloy catalyst material (made by the modified Adams method as described above or by some alternative technique), with a Teflon dispersion to produce the bonded electrode structure in the manner described in U.S. Pat. No. 3,297,484. In the process of bonding the electrode, the catalyst may be blended with Teflon dispersions in such a manner that the dispersion contains little or no hydrocarbons. This mode of fabrication is also discussed in U.S. Pat. No. 4,039,409 and is not critical in the practice of the present invention.

Although the invention is not to be limited to any particular theory, the following explanations may help to explain the stabilization of the ruthenium oxide by the manganese oxide. Corrosion investigations of ruthenium oxide and kinetic studies of oxygen evolution on ruthenium oxide point to valence changes in the ruthenium surface atoms in the course of oxygen electrocatalysis. Some of these valence states of ruthenium are unstable in acidic environments and undergo dissolution while others are inactive toward oxygen. Manganese (ultimately in the form of the oxide) is added to ruthenium oxide in a concentration of about 5% to about 25% by weight (metal content) to form a single phase of the oxides which possesses the activity for oxygen evolution approaching that of ruthenium oxide anode catalyst alone but having vastly increased stability. The manganese of the manganese oxide interacts with the ruthenium of the ruthenium oxides on an atomistic level to preclude the irreversable change of state of ruthenium and, therefore, the corrosion and loss of performance. Ruthenium metal is somewhat less stable than the other platinum group metals, and since the stability of the base metal is directly related to the stabilities of the surface oxides formed under different conditions, and since ruthenium anode catalyst material is composed of only oxides with no base metal present, the corrosion behavior of the anode catalyst material relates to the stability of the oxides of ruthenium. It has been establishes that the hydrated ruthenium oxide is stable in neutral and acid media below an applied potential of about 1.4 volts versus the reversible hydrogen electrode in the same medium and in the absence of complexing agents. When the voltage is increased above 1.4 volts, the hydrated ruthenium oxide ($RuO_2 \cdot H_2O$) undergoes oxidation to the ruthenates or perruthenates ($RuO_4^{2-}$ and $RuO_4^{-1}$ respectively) which most probably undergo decomposition at pH values less than 7.5 to the hydrated ruthenium oxide and a soluble ruthenium species, e.g., $H_2RuO_5$ where ruthenium is in the 8+ state. This oxidation of the hydrated ruthenium oxide takes place by proton transfer in the hydrated oxide layer. It is also known that ruthenium oxide can be stabilized for a short time by thermal treatments. This stabilization dehydrates the oxide lattice rendering it crystalline with the ruthenium oxide structure. In this condition, there is no mechanism for proton transfer in the oxide with the associated valence changes, thus maintaining ruthenium in the 4+ valence state and precluding bulk dissolution. However, this condition is not permanent and gradual hydration/oxidation at the surface lends this material unstable with time. In the course of oxygen or chlorine evolution on ruthenium oxide, the electrocatalytic activity of which is well-known, the anode potential approaches or surpasses the 1.4 volts corrosion potential. Hence, the corrosion takes place, and it is desirable to stabilize the ruthenium oxide. Manganese oxide has been found to stabilize the ruthenium oxide in the anode catalyst. In the pH and potential region of interest for oxygen and chlorine evolution, the pH region for oxygen generation generally being about 1.5 and the pH region for chlorine generation being somewhat alkaline up to about 10, manganese oxide is known to be stable. The ionic radius of the 4+ valence state of manganese differs by only 10% from that of the ruthenium 4+ valence state and that of manganese 3+ valence state differs only by 3% from that of ruthenium 4+ valence. Thus, the solid solution mixed oxides form a stabilized form of ruthenium oxide when stabilizing amounts of manganese are used with the ruthenium.

The following examples further illustrate the practice of the invention and they are meant to be exemplary only and are not to be construed as limiting the invention in any way.

EXAMPLE 1

To illustrate the ruthenium oxide-manganese oxide alloy used as the anode catalyst in the present invention, a 90% ruthenium oxide-10% manganese oxide (by weight) material was prepared by the modifid Adams process discussed above, and an X-Ray diffraction pattern of the alloy was studied before and after calcination.

Finely-divided ruthenium chloride and manganese sulfate was mixed in a ratio of 10 weight percent manganese sulfate and 90 weight percent ruthenium chloride (the same weight ratio of manganese and ruthenium desired in the final alloy), and an excess of sodium nitrate was incorporated in the mixture. The mixture was fused in a silica dish at 500° C. for 3 hours to form a molten liquid of the reaction products which are cooled and formed a solid block of the reaction products. The resulting product was comminuted and washed thoroughly with water to remove soluble products such as nitrates, halides and sulfates therefrom. The resulting product was then dried, and the sample was analyzed for its X-Ray diffraction pattern. The diffraction pattern is reported in Table 1 below.

TABLE 1

X-RAY* DIFFRACTION PATTERN OF 90% RUTHENIUM OXIDE-10% MANGANESE OXIDE

| | Uncalcined | | | Calcined | | |
|---|---|---|---|---|---|---|
| (hkl) | Region of Scan Pattern 2θ | Intensity of Pattern | Lattice Spacing d(A) | Region of Scan Pattern 2θ | Intensity of Pattern | Lattice Spacing d(A) |
| 110 | 28.2 | 100 | 3.16 | 27.7 | 57 | 3.22 |
| 101 | 35.3 | 100 | 2.542 | 34.9 | 46 | 2.571 |
| 200 | 40.1 | 37 | 2.248 | 39.8 | 16 | 2.264 |
| 111 | — | — | — | 40.5 | 8 | 2.227 |
| 210 | 45.1 | 5 | 2.010 | 44.9 | 2 | 2.018 |
| 211 | 54.6 | 100 | 1.680 | 54.2 | 45 | 1.692 |
| 220 | 58.1 | 40 | 1.588 | 57.9 | 14 | 1.593 |
| 002 | 59.7 | 18 | 1.549 | 59.5 | 4 | 1.554 |
| 310 | 65.8 | 30 | 1.420 | 65.5 | 9 | 1.425 |

TABLE 1-continued

X-RAY* DIFFRACTION PATTERN OF 90% RUTHENIUM OXIDE-10% MANGANESE OXIDE

| | Uncalcined | | | Calcined | | |
|---|---|---|---|---|---|---|
| (hkl) | Region of Scan Pattern 2θ | Intensity of Pattern | Lattice Spacing d(A) | Region of Scan Pattern 2θ | Intensity of Pattern | Lattice Spacing d(A) |
| 112 | 67.4 | 27 | 1.390 | 67.0 | 7 | 1.397 |
| 301 | 69.8 | 35 | 1.347 | 69.6 | 11 | 1.351 |
| 202 | 74.5 | 8 | 1.274 | 74.1 | 4 | 1.280 |
| 321 | 83.7 | 18 | 1.156 | 83.6 | 5 | 1.157 |
| 400 | 86.8 | 6 | 1.122 | 86.7 | 2 | 1.123 |
| 222 | 88.0 | 12 | 1.110 | 88.2 | 3 | 1.108 |
| 330 | 93.8 | 6 | 1.056 | 93.3 | 2 | 1.060 |
| 312 | 94.8 | 12 | 1.048 | 94.7 | 3 | 1.048 |
| 411 | 97.2 | 15 | 1.028 | 97.1 | 3 | 1.029 |
| 420 | 100.2 | 9 | 1.005 | 100.2 | 2 | 1.005 |
| 213 | 114.3 | 5 | .919 | 114.0 | 2 | .920 |
| 402 | 116.3 | 9 | .907 | 115.8 | 1 | .9105 |
| 510 | 122.1 | 5 | .881 | 122.0 | 1 | .8820 |
| 332 | 123.9 | 7 | .874 | 123.6 | 1 | .8750 |
| 501 | 126.6 | 12 | .863 | 126.35 | 3 | .8640 |
| 303 | 130.2 | 5 | .850 | 130.0 | 2 | .851 |
| 422 | 132.4 | 10 | .843 | — | — | .844 |
| 521 | 146.6 | 8 | .805 | 132.0 | 2 | .805 |
| 323 | 152.2 | 6 | .794 | — | — | — |
| 440 | 153.3 | 6 | .793 | 152.2 | 2 | .794 |

*Using CuKα Radiation

The data from the scan as evidenced by the diffraction pattern shown in Table 1 above, indicates that the manganese oxide is completely dissolved in the ruthenium oxide phase. The X-Ray diffraction pattern before and after calcination was similar except for the increased sharpness in diffraction lines for the calcined ruthenium oxide-manganese oxide catalyst. From the diffraction pattern, it is concluded that the manganese oxide is present in the ruthenium oxide in solid solution.

EXAMPLE 2

A brine electrolysis cell similar to that shown in FIG. 1 was constructed for the generation of chlorine gas from brine. The solid polymer electrolyte ion transporting membrane was a membrane made from a cation exchange resin, and the membrane was supplied by E. I. Dupont deNemours and Company under the trademark NAFION 315. The cathode catalyst material was a combination of platinum and graphite. The platinum catalyst was a conventional catalyst made by the modified Adams process discussed above. The platinum catalyst and graphite were mixed in a ratio of 0.4 mg/cm$^2$ to 1.8 mg/cm$^2$ graphite, and was placed upon and bonded to the membrane in the form of a decal. The Anode catalyst consisted of an alloy of 90% ruthenium oxide and 10% manganese oxide made by the process described in Example 1. The anode catalyst was formed into a decal and bonded to the surface of the ion transporting membrane opposite the cathode. The anode collector was an iridium-coated titanium in the form of a screen, and the cathode collector was a conventional screen mounted against the cathode. The electrochemical cell was operated at a temperature of 92° C. at a current load of 300 amps/ft$^2$. The catholyte was a 4.0 to 7.0 molar aqueous sodium hydroxide solution, and the anolyte was an aqueous sodium chloride solution having a concentration of 180–316 grams per liter sodium chloride. The active area of the cell was 2.5 ft$^2$.

After 131 hours of operation at 90° C. and 300 amps/ft$^2$, the cathode efficiency was calculated at 83–87%, and the sodium hydroxide concentration in the catholyte was 4.0 to 5.0 molar. This cell performance is essentially a baseline performance similar to the equivalent cell using a ruthenium/iridium catalyst as an anode.

After 299 hours of operation (from the initial start up) the cell voltage was 3.55 volts, and the cathode efficiency was 78% with a sodium hydroxide concentration of 4.9 molar. At 449 hours of continuous operation, the cell voltage was 3.60 volts and the cathode efficiency was 73–87% with a sodium hydroxide concentration of 4.3 to 5.6 molar.

At various times during continuous operation, the cell voltage cathode efficiency and sodium hydroxide concentration were determined. These are recorded in Table 2 below.

TABLE 2

CELL VOLTAGE vs. OPERATING TIME

| TIME (hours) | CELL VOLTAGE (volts) | CATHODE EFFICIENCY (%) | NaOH CONCENTRATION (MOLAR) |
|---|---|---|---|
| 131 | 3.5 | 83–87 | 4–5 |
| 299 | 3.55 | 78 | 4.9 |
| 449 | 3.60 | 73–87 | 4.3–5.6 |
| 561 | 3.60 | 77–86 | 4.2–5.7 |
| 697 | 3.55–3.60 | 63–89 | 2.9–8.9 |
| 809 | 3.55–3.60 | 79–92 | 2.9–5.1 |

The cell voltages reported above and unless otherwise specified, are total cell volts including the IR loss.

After 809 hours of operation, the cell was shut down and moved to a new location where it was reassembled. After about 30 days of shut-down time, the cell was started up and operated as previously described at 90° C. and 300 amps/ft$^2$. After 918 hours of operation from the initial start-up described in Table 2 above, cell voltage was 3.70 volts. After 1,040 hours, the cell voltage was 3.85 volts. This increase in voltage was probably the result of failure of the pump for the circulation of anolyte and the cessation of the flow of brine (sodium chloride solution) into the anode compartment. After the replacement of the pump and after 1,308 hours of operation (from the initial start-up described in Table 2 above), the cell voltage was 3.75 volts. Thus, there was a recovery to the lower cell voltage after replacement of the pump and circulation of brine into the anode compartment. After 1,476 hours, the cell voltage was 3.78 volts, and after 1,587 hours, the cell voltage was 3.7 to 3.8 volts. At this point in time the electrolysis was discontinued and the electrochemical cell was shut down due to power supply rectifier failure. The experiment was not re-started.

A study of the data in Example 2 indicates that the performance is as good as that of an electro chemical cell for the electrolysis of brine using prior art catalysts such as ruthenium oxide or ruthenium/iridium alloys as anode catalyst materials. Thus, the use of the manganese oxide in the anode catalyst at a substantial reduction in initial costs because of the substantially lower price of manganese, does not compromise the quality of the cell performance. Furthermore, the physical examination of the anode material at the termination of the run showed very little corrosive effect upon the ruthenium oxide/-manganese oxide catalyst material.

EXAMPLE 3

An electrochemical cell for the electrolysis of brine similar to the cell described in Example 2 above was assembled and operated for 26 hours at 92° C. using a 90% ruthenium oxide-10% manganese oxide anode catalyst and a cathode catalyst comprising 0.4 mg/cm$^2$ platinum and 1.8 milligram/cm$^2$ graphite. The cell area was 2.5 ft$^2$. The cell voltage in volts was measured at various current densities in amps/ft$^2$. The results are set forth in Table 2 below:

TABLE 3

CELL VOLTAGE vs. DENSITY

| *CELL VOLTAGE (volts) | CURRENT DENSITY (amps/ft$^2$) |
|---|---|
| 2.56 | 100 |
| 2.96 | 200 |
| 3.35 | 300 |
| 3.74 | 400 |

*Cell voltage is corrected to hardware IR losses.

As can be seen from the data in Table 3, the performance of the cell having the 90% ruthenium oxide/10% manganese oxide anode catalyst material is as good as or better than (in terms of current densities) the prior art anode catalysts which are more expensive, and it can be concluded that the catalyst having the substantially cheaper manganese oxide as an ingredient in the alloy, does not compromise the efficiency or performance of the electrochemical cell for the electrolysis of brine.

EXAMPLE 4

An electrochemical cell similar to the cell described in Example 2 above for the electrolysis of brine was assembled using an anode catalyst made from 90% ruthenium oxide-10% manganese oxide as described in Example 1 above. The cell was operated at a temperature of 90° C. and at a current density of 300 amps/ft$^2$. The cell size was 2.5 ft$^2$. The anolyte and catholyte were similar to those described in Example 2. At start-up the cell voltage was 3.50 volts (not corrected to hardware IR losses), and after 1600 hours of continuous operation the cell voltage was 3.77 volts. The cathodic efficiency was 83%. The product caustic (aqueous sodium hydroxide) was 14–17% caustic by weight.

The cell voltage and current efficiency performance using the ruthenium oxide-manganese oxide alloy anode catalyst material and the durability of the anode catalyst are similar to the catalysts made of the more expensive ruthenium oxide-iridium oxide catalyst materials.

EXAMPLE 5

A 2.5 foot square cell similar to the electrochemical cell for the electrolysis of brine described in Example 2 above was made for the generation of chlorine. The metal bellows cell had low-loaded cathode and anode catalysts similar to those described in Example 2, and the anode catalyst material was 90% ruthenium oxide-10% manganese oxide as described in Example 1. The anode collector screen was iridium-coated titanium. After 450 hours of electrolysis of brine, the cell voltage was at the baseline voltage for the conventional solid polymer electrolyte membrane made with a conventional cation exchange resin of the sulfonic acid type and identified by E. I. Dupont de Nemours and Co. As the NAFION 315 membrane.

EXAMPLE 6

Tests were conducted upon various anode catalysts made from 75% ruthenium oxide and 25% of representative elements in IV-B, V-B and VI-B of the Periodic Chart of the Elements. The catalysts were made in accordance with the modified Adams process discussed above and described in Example 1 above by using the halide salts (chlorides) or other suitable salts of the particular metal. The catalysts containing 75% ruthenium oxide and 25% of the oxide of zirconium, niobium, tantalum, tungsten, titanium, or hafnium, were not tested in the electrolysis of brine, but were tested as anode catalysts in electrochemical cells for the electrolysis of water at a current density of 1,000 amps/ft$^2$ and a cell temperature of 180° F. (82° C.). Cell performance as represented by cell voltage in volts, was suitable for each of the anode catalysts of this example for the electrolysis of water at the initial start-up of the electrolysis. However, after 24 hours of continuous operation of the water electrolysis cell, cell performance substantially deteriorated using the anode catalyst containing 75% ruthenium oxide-25% titanium oxide, and containing 75% ruthenium oxide-25% hafnium oxide. After 48 hours of continuous operation of the water electrolysis cells, cell performance for the remaining anode catalyst materials of this example, namely, 75% ruthenium oxide-25% zirconium oxide; 75% ruthenium oxide-25% niobium oxide; 75% ruthenium oxide-25% tantalum oxide; and 75% ruthenium oxide-25% tungsten oxide, had substantially deteriorated as evidenced by the high cell voltage. Thus, none of these anode catalyst materials had acceptable stability for the electrolysis of water, and under similar circumstances none of these anode catalyst materials have acceptable stability for the electrolysis of brine.

The data demonstrates that less expensive oxygen generating catalytic anodes can be prepared and operated in electrolysis cells for the electrolysis of brine substantially as efficiently as the prior art catalytic halogen-evolving anodes. By this invention it is now possible to obtain the advantages of gas generation by the electrolysis of brine with ruthenium oxide anode catalyst materials without incurring the disadvantage of corrosion normally encountered when the ruthenium oxide catalyst material is utilized as an anode in an electrochemical cell. An improved electrocatalyst has been demonstrated as a gas evolving electrode, and chlorine has been produced by the electrolysis of brine utilizing an improved anode catalyst having substantially greater stability than the heretofore preferred prior art anode catalyst materials. By using the ruthenium oxide-manganese oxide catalysts of this invention, there is little or no deterioration in cell voltage or cell efficiency over relatively long periods of cell operation, and there is little or no corrosion or deterioration of the anode catalyst over substantially long periods of electrochemical activity.

While other modifications of the invention and variations thereof which may be employed within the scope of the invention have not been described, the invention is intended to include such modifications as may be embraced within the following claims.

What is claimed is:

1. Apparatus for the evolution of halogen gas comprising:

(a) a catalytic cathode;

(b) a catalytic halogen-evolving anode stabilized against corrosion in neutral or acidic media at anodic potentials in excess of 1.4 V comprising a catalyst of ruthenium oxide and manganese oxide;

(c) a solid polymer electrolyte ion transporting membrane disposed between and separating the catalytic cathode and the catalytic halogen evolving-anode, at least one of the cathode and anode being bonded to the respective surface of the membrane;

(d) means for supplying a medium to said anode for evolving halogen in an electrolysis reaction at the stablized anode; and (e) means for providing a direct current potential between the cathode and anode in excess of 1.4 V for evolving halogen at the anode without corrosion of the anode catalyst.

2. The apparatus of claim 1 wherein the stabilized corrosion-resistant anode comprises manganese oxide and ruthenium oxide in solid solution where said manganese oxide is substantially completely dissolved in the ruthenium oxide.

3. The apparatus of claim 2 wherein the anode comprises about 5 weight percent to about 25 weight percent manganese oxide.

4. The apparatus of claim 1 wherein the neutral or acidic medium supplied to the anode for the evolution of a halogen is a chloride and the halogen evolved is chlorine.

5. The apparatus of claim 1 wherein the neutral or acidic medium supplied to the anode for the evolution of a halogen is a bromide and the halogen evolved is bromine.

* * * * *